US006074218A

United States Patent [19]

Wu et al.

[11] Patent Number: 6,074,218

[45] Date of Patent: Jun. 13, 2000

[54] AUDIO JACK CONNECTOR

[75] Inventors: Kun-Tsan Wu, Taipei Hsien; Jen-Jou Chang, Yung-Ho, both of Taiwan

[73] Assignee: Hon Hai Precision Ind. Co., Ltd., Taipei Hsien, Taiwan

[21] Appl. No.: 09/200,285

[22] Filed: Nov. 23, 1998

[30] Foreign Application Priority Data

Nov. 22, 1997 [TW] Taiwan ..... 86219639

[51] Int. Cl.[7] ..... H01R 9/09

[52] U.S. Cl. ..... 439/63; 439/607; 439/608

[58] Field of Search ..... 439/63, 581, 607, 439/608, 610, 55, 541.5

[56] References Cited

U.S. PATENT DOCUMENTS 4,611,878 9/1986 Hall et al. ..... 439/63
4,846,719 7/1989 Iwashita ..... 439/63
5,108,300 4/1992 Weber ..... 439/188
5,622,523 4/1997 Kan et al. ..... 439/607
5,722,837 3/1998 Kurahashi ..... 439/63

*Primary Examiner*—Khiem Nguyen
*Assistant Examiner*—Son V. Nguyen

[57] ABSTRACT

An audio jack connector comprises an insulative housing having a mating face and a soldering face, at least one hollow cylinder extending from the mating face and defining a recess therein. A passageway is defined in an inner wall of each cylinder for receiving a contact which projects into the recess for electrically contacting an inserted plug. A retaining member comprises a first hook and a second hook extending from the mating face of the housing. A grounding member comprises a metal base from which at least one metal tube extends for mating with and enclosing the corresponding cylinder of the housing, wherein the metal base is sized to be retainable between the first hook and the second hook of the retaining means and the mating face of the housing.

16 Claims, 6 Drawing Sheets

AUDIO JACK CONNECTOR

BACKGROUND OF THE INVENTION

1. Field of the Invention

The present invention relates to an audio jack connector and particularly to an audio jack connector providing an excellent noise shielding effect.

2. The Prior Art

Current audio jack connectors commonly include a shielding for preventing noise interference from adversely affecting signal transmission. Normally, the connectors are covered with a metal shielding for suppressing noise and cooperating with a mating connector to form a grounding loop for guiding noise to ground during insertion or withdrawal of the mating connector. Japanese Patent Nos. 58-26173, 57-18273, and 59-285 discloses audio jacks utilizing engaging slots defined in an insulative housing for engaging with a metal shielding to suppress noise. However, these engagements are apt to be released during accidental impact with other parts during shipping and transport. Therefore, it is requisite to provide a new audio jack unitary having a new structure for firmly securing the metal shielding to the housing.

SUMMARY OF THE INVENTION

The primary purpose of the present invention is to provide a new audio jack connector having a strongly engaged shielding structure.

A second purpose of the present invention is to provide a new audio jack connector having an excellent noise shielding effect.

In accordance with one aspect of the present invention, an audio jack connector comprises an insulative housing having a mating face and a soldering face, at least one hollow cylinder extending from the mating face and defining a recess between the mating face and the soldering face, a passageway defined in an inner wall of each hollow cylinder for receiving a contact which projects into the recess, two upper side walls extending from the mating face and each defining a recess therein. Retaining means comprises a first hook and a second hook extending through the recesses of the upper side walls of the housing, respectively. A first grounding member comprises a metal base from which at least one metal tube extends for mating with and enclosing the corresponding cylinder of the housing, wherein the metal base is sized to be retainable between the first hook and the second hook of the retaining means and the mating face of the housing.

These and additional objects, features and advantages of the present invention will become apparent after reading the following detailed description of the preferred embodiment of the invention taken in conjunction with the appended drawing figures.

DETAILED DESCRIPTION OF THE PREFERRED EMBODIMENTS

Figure 1:
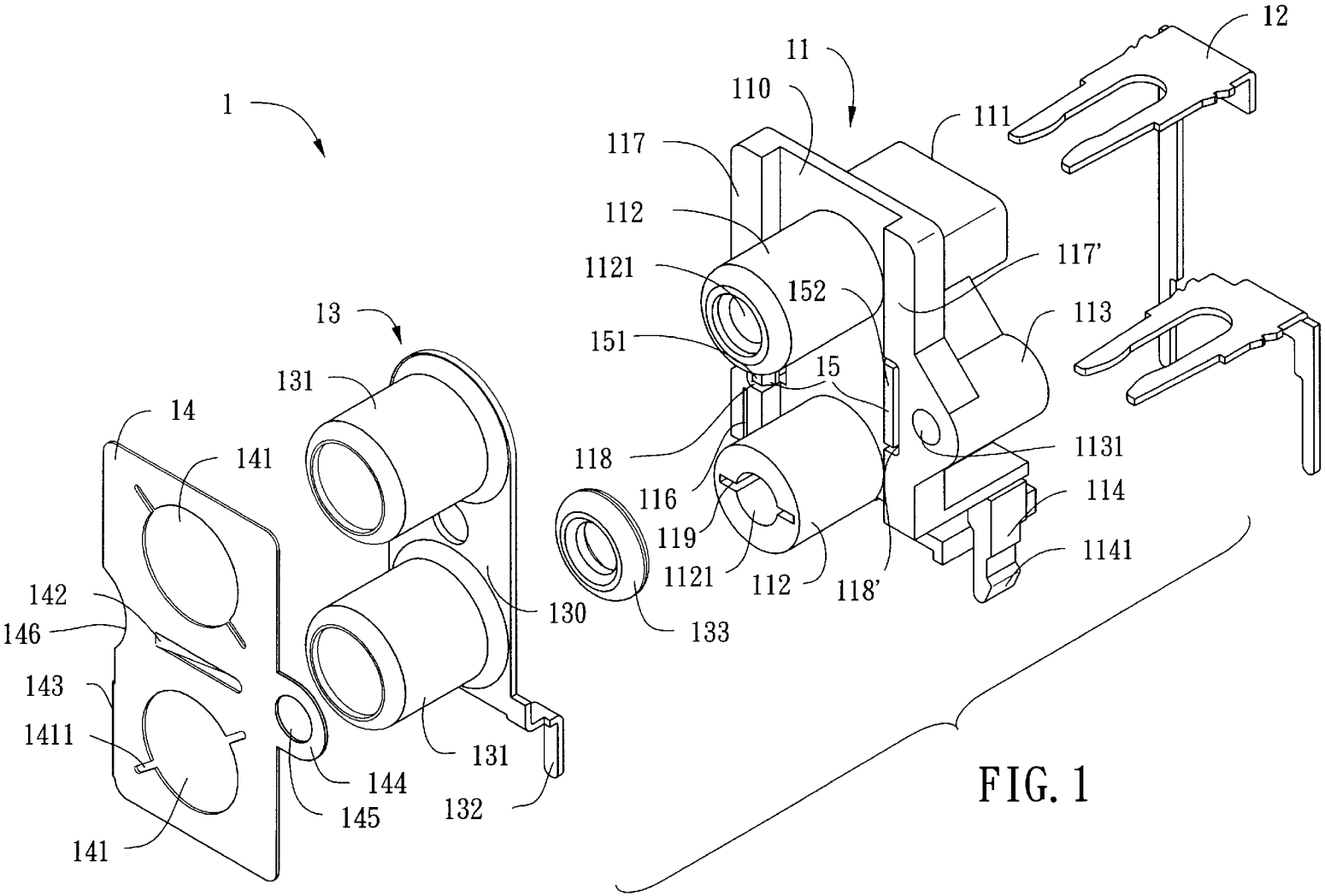
FIG. 1 is an exploded view of an audio jack connector in accordance with the present invention.
Figure 5:
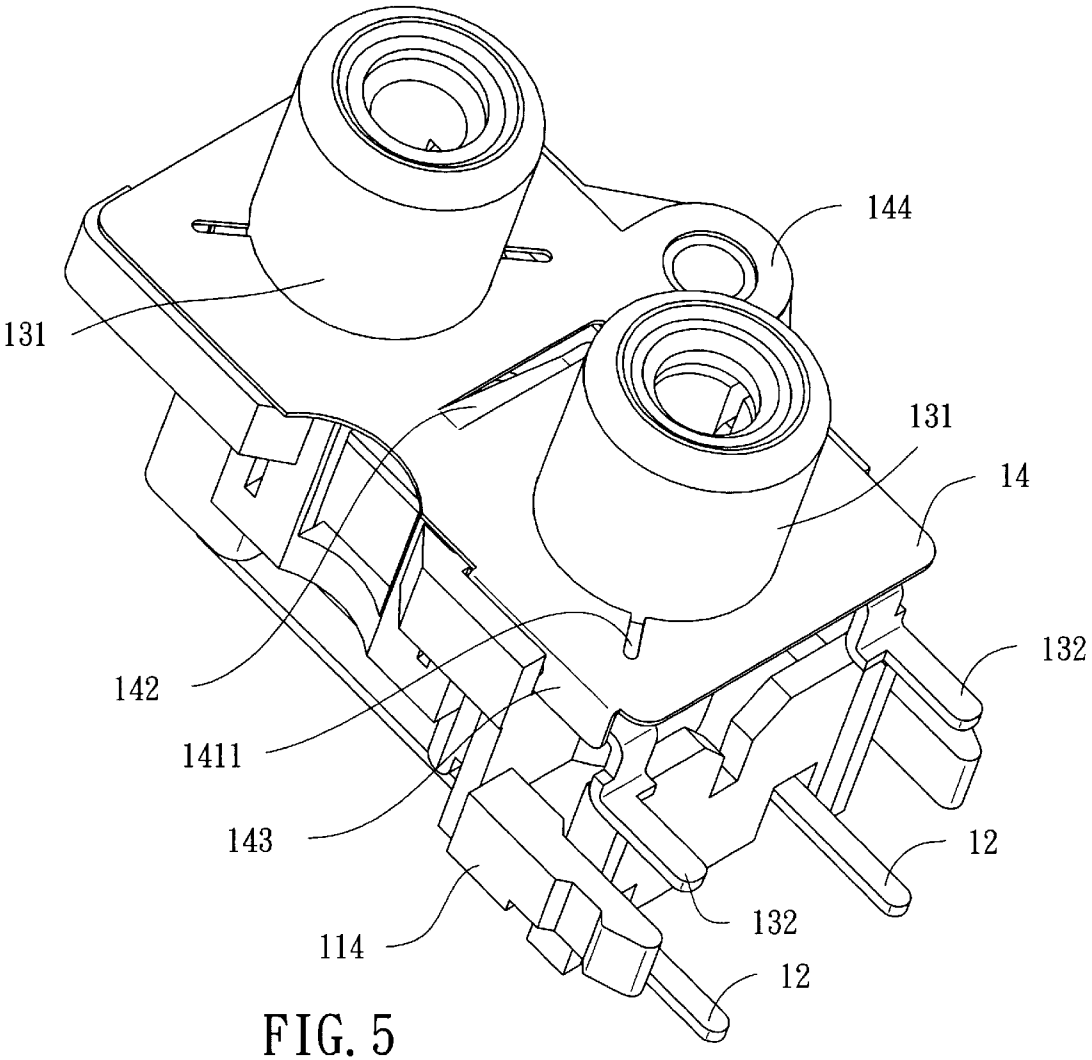
FIG. 5 is a fully-assembled view of FIG. 1.

Referring to FIGS. 1 and 5, an audio jack connector 1 in accordance with the present invention comprises an insulative housing 11, two contacts 12 partially received in the housing 11, a first grounding member 13 engaging with an upper face of the housing 11, a second grounding member 14 engaging with the upper face of the housing 11 and together sandwiching a plane portion of the first grounding member 13, and retaining means 15 extending from the housing 11 for retaining the second grounding member 14 on the plane portion of the first grounding member 13.

Figure 2:
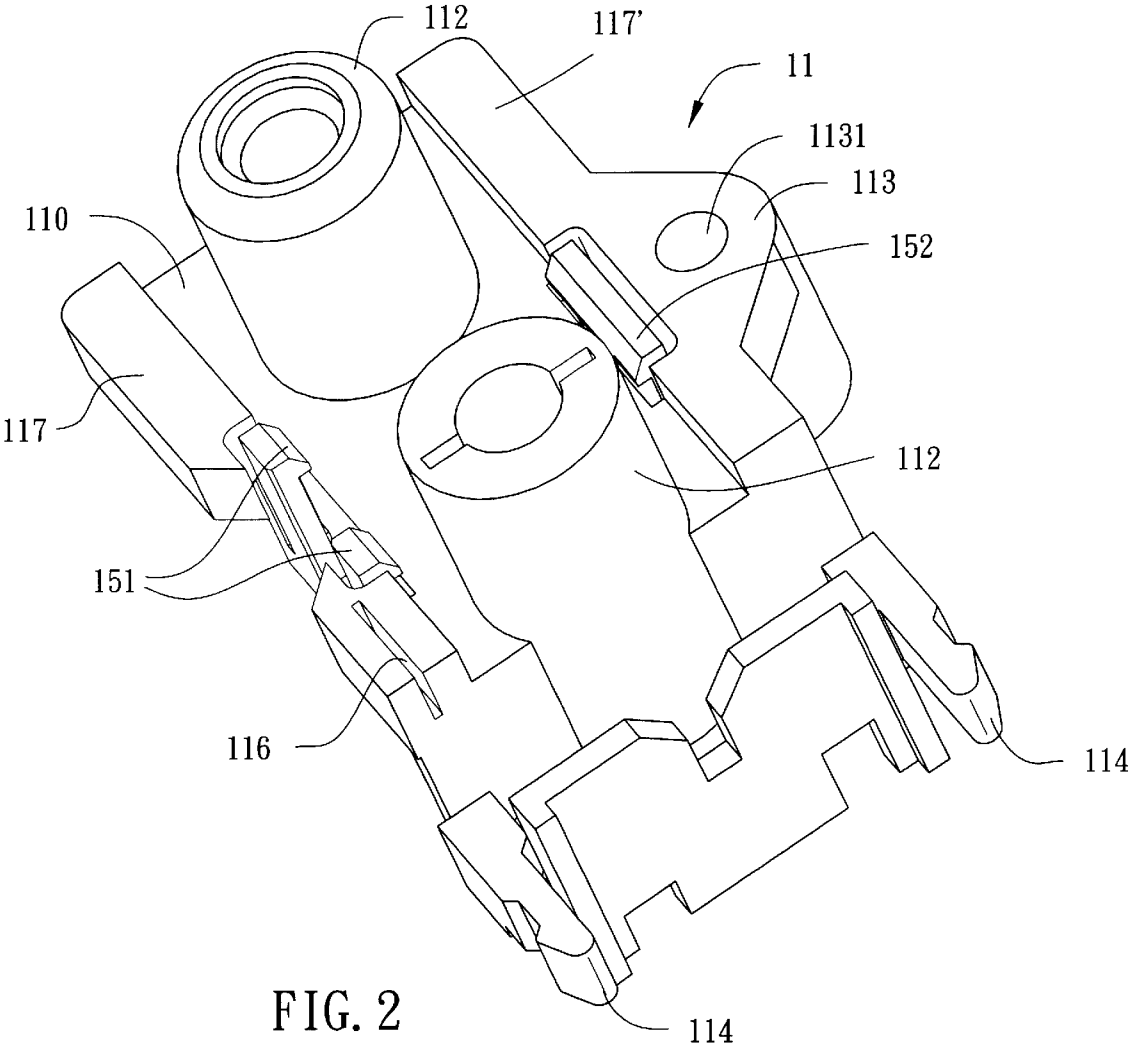
FIG. 2 is an enlarged perspective view of the insulative housing of FIG. 1 viewed from different angle for showing the structure thereof in more detail.

Also referring to FIG. 2, the housing 11 has a mating face 110 and a soldering face 111 through which passageways 119 are defined for receiving the contacts 12 wherein a portion of the contacts 12 extend out of the passageways 119. Two hollow cylinders 112 extend from the mating face 110, each defining a recess 1121 for receiving a mating plug (not shown).

The passageways 119 are defined in an inner wall of each recess 1121 and in communication with the recess 1121 so that the contacts 12 received therein are electrically connected to the inserted plug. Two upper side walls 117, 117' extend from opposite sides of the mating face 110. The upper side walls 117, 117' respectively define a first recess 118 and a second recess 118' confronting each other. The side wall 117 defines a reception slit 116. An engaging part 113 formed like a cylinder is integrally formed with the side wall 117' and extends from the mating face 110 to the soldering face 111. The engaging part 113 defines a threaded hole 1131 therein for cooperating with a screw (not shown) to fix the second grounding member 14 to the housing 11. Two fixing posts 114 extend from a lower wall of the housing 11 and each includes a hook 1141 for engagement with corresponding holes of a printed circuit board (not shown) thereby fixing the housing 11 thereto.

Figure 3B:
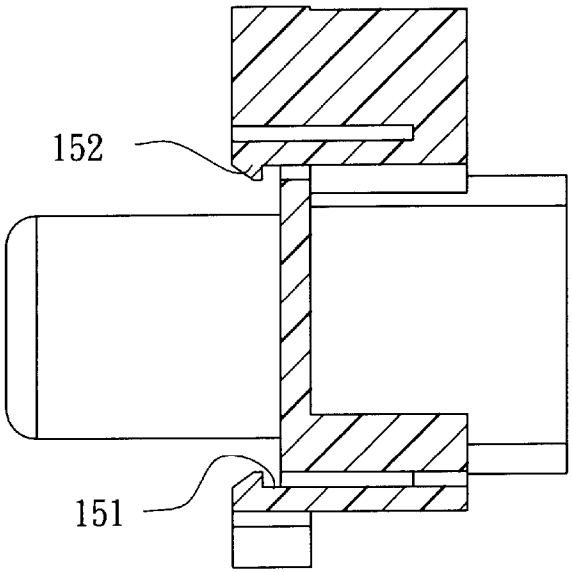
FIG. 3B is a cross-sectional view taken along line 3B—3B of FIG. 3A.
Figure 3A:
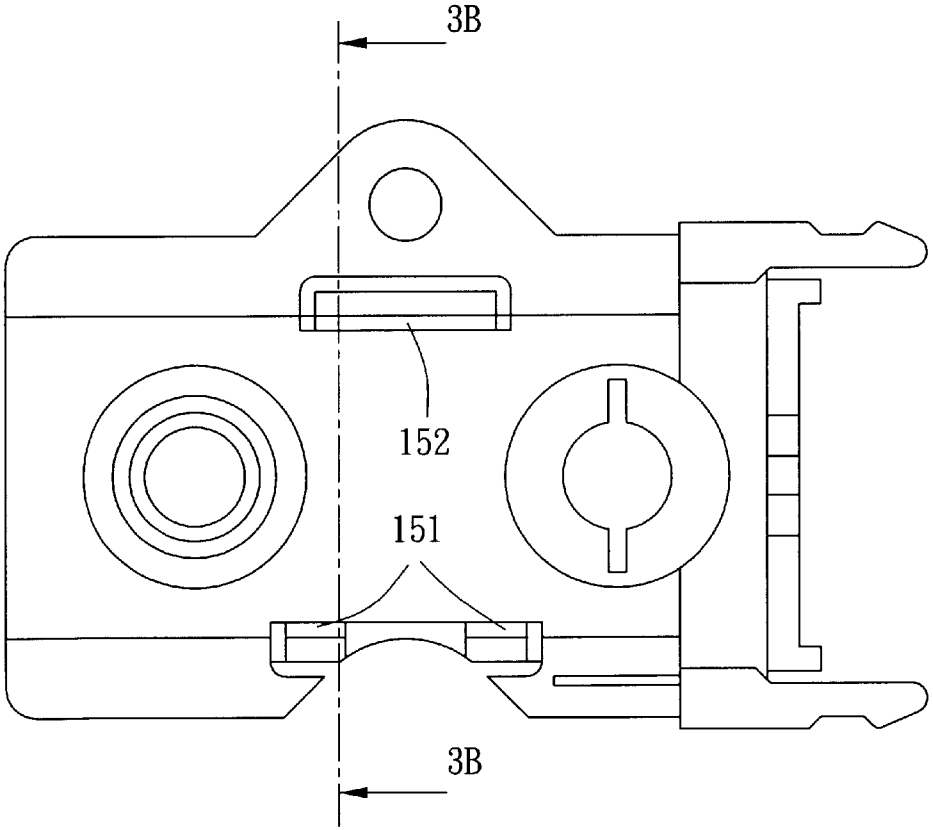
FIG. 3A is a front view of the insulative housing of FIG. 2.

Also referring to FIGS. 3A and 3B, the retaining means 15 comprises two narrow hooks 151 extending through the first recess 118 and a wide hook 152 extending through the second recess 118' wherein the hooks 151, 152 extend substantially to a top surface of the corresponding upper side wall 117, 117'. Both the narrow hooks 151 and the wide hook 152 are bendable within the first and second recesses 118, 118' of the housing 11.

Figure 4:
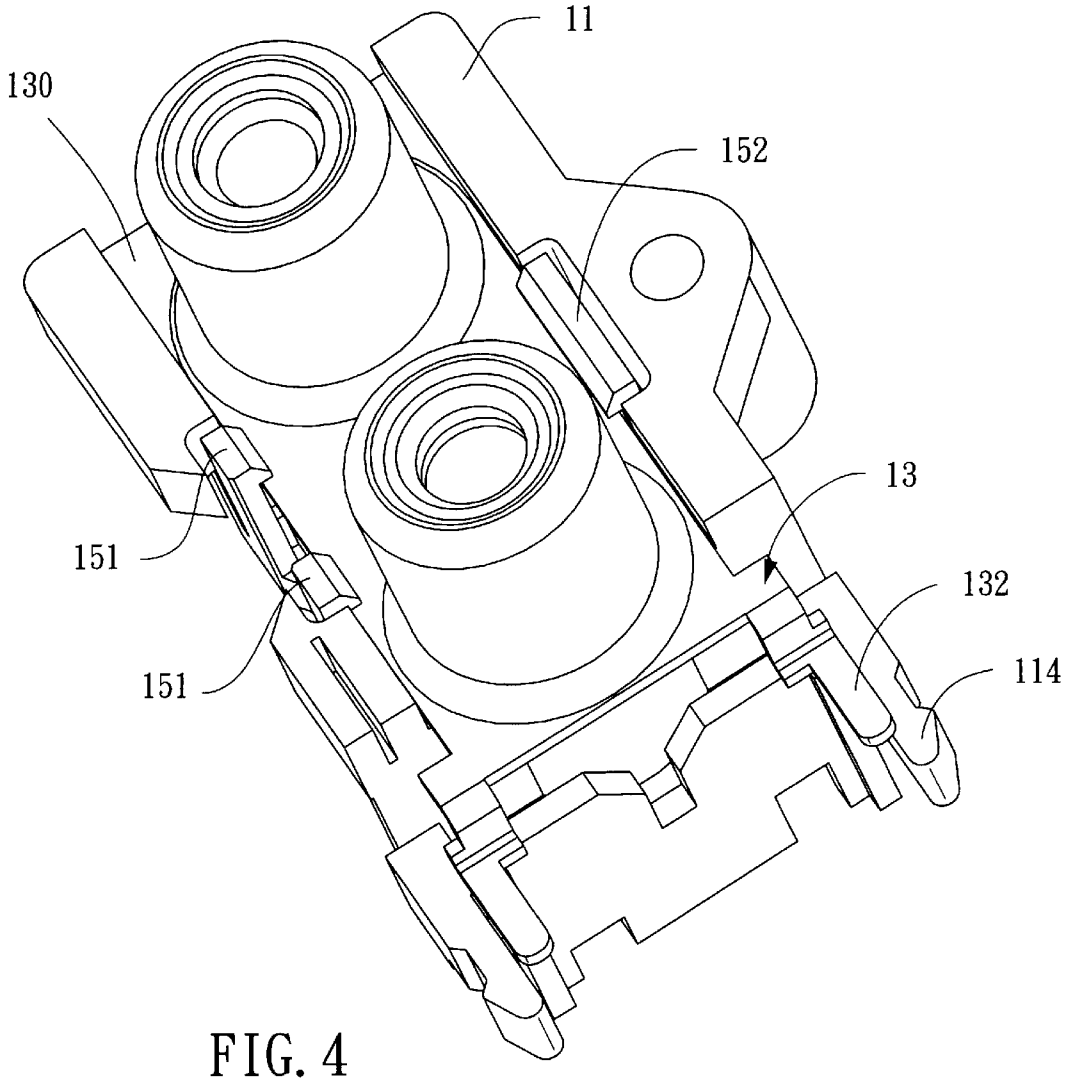
FIG. 4 is a semi-assembled view of FIG. 1.

The first grounding member 13 comprises a metal base 130 from which two metal tubes 131 extend for respectively mating with and enclosing the corresponding cylinders 112 of the housing 11, and two metal collars 133 for engaging with a top of the cylinder 112. Referring to FIG. 4, the metal base 130 of the first grounding member 13 is sized to be retainable between the retaining means 15 and the mating face 110 of the housing 11 so that the first grounding member 13 can provide a good shielding effect and suppressed external noise from acting on the housing 11. A grounding tab 132 extends from a corner of the metal base 130 for soldering to a grounding pad (not shown) of the related printed circuit board.

Also referring to FIG. 5, the second grounding member 14 defines two holes 141 and two slits 141' in communication therefrom for providing a flexible engagement with the tubes 131 of the first grounding member 13. An engaging tab 143 extends from the second grounding member 14 for engaging with the reception slit 116 of the housing 11 when the second grounding member 14 is configured to the housing 11. An engaging portion 144 extends from one side of the second grounding member 14 substantially mating with a top face of the engaging part 113 of the housing 11 and defines a hole 145 aligning with the engaging hole 1131 of the engaging part 113 thereby allowing a screw (not shown) to fix the second grounding member 14 to the housing 11 which together sandwich the first grounding member 13 therebetween. A curved cutout 146 is defined in one side of the grounding member 14.

Figure 6B:
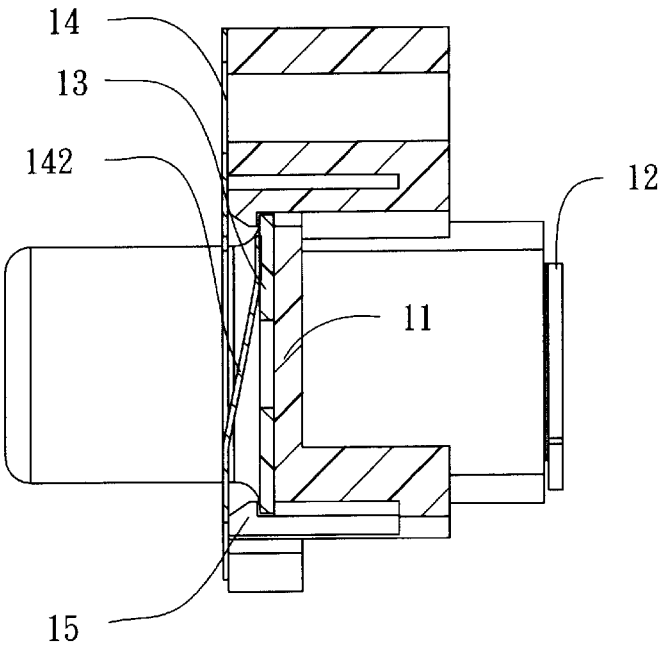
FIG. 6B is a cross-sectional view taken along line 6B-6B of FIG. 6A.
Figure 6A:
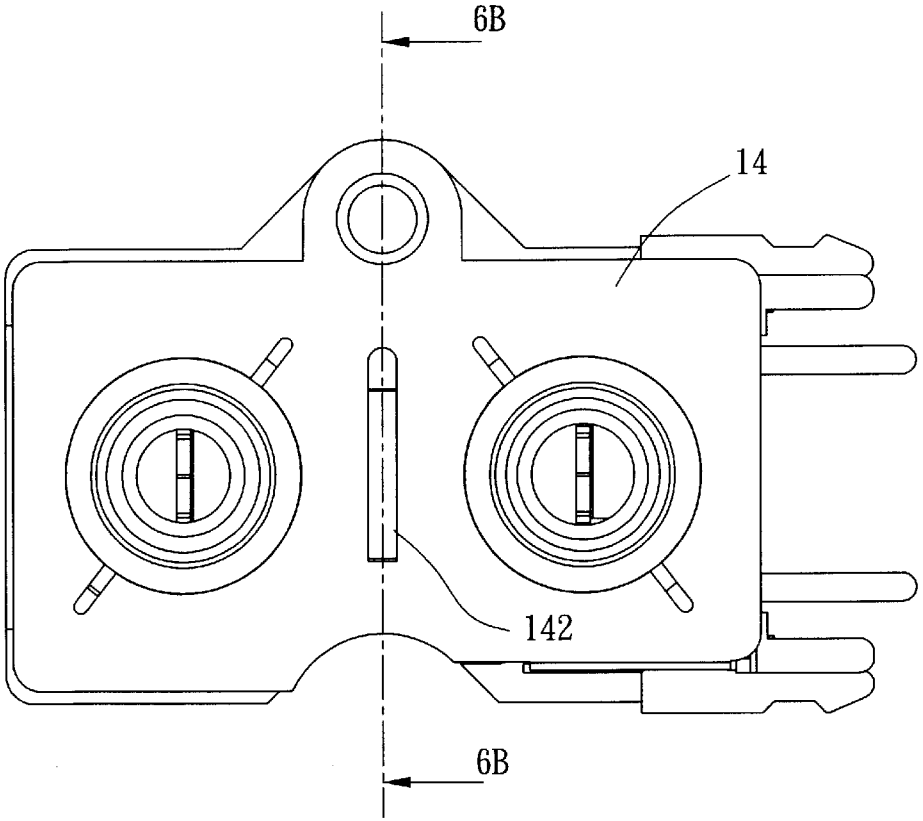
FIG. 6A is a front view of FIG. 5.

Also referring to FIGS. 6A and 6B, an engaging tab 142 is formed at the center of the second grounding member 14 by stamping for abutting against the metal base 130 of the first grounding member 13 for ensuring electrical engagement between the first and second grounding members 13, 14.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. An audio jack connector comprising:

an insulative housing having a mating face and a soldering face, at least one hollow cylinder extending from the mating face and defining a recess therein between the mating face and the soldering face, a passageway defined in an inner wall of each cylinder for receiving a contact which projects into the recess, two upper side walls extending from the mating face and each defining a recess therein;

retaining means comprising a first hook and a second hook respectively extending through the recesses of the housing;

a first grounding member comprising a metal base from which at least one metal tube extends for mating with and enclosing the corresponding cylinder of the housing, wherein the metal base is sized to be retainable between the first hook and the second hook of the retaining means and the mating face of the housing.

2. The audio jack connector as claimed in claim 1, wherein the first and second hooks are bendable within the recesses of the upper side walls of the housing for facilitating the positioning of the first grounding member on the mating face of the housing.

3. The audio jack connector as claimed in claim 2 further comprising a second grounding member attached to the metal base of the first grounding member.

4. The audio jack connector as claimed in claim 3, wherein the housing has an engaging part integrally formed with the side wall, extending from the mating face, to the soldering face and defining a threaded hole therein for cooperating with a screw to fix the second grounding member on the housing.

5. The audio jack connector as claimed in claim 4, wherein a reception slit is defined in one of the upper side walls of the housing and an engaging tab extends from the second grounding member for engaging with the reception slit.

6. The audio jack connector as claimed in claim 1, wherein the housing has two fixing posts extending from a lower wall thereof and each fixing post includes a hook for engagement with an external printed circuit board.

7. The audio jack connector as claimed in claim 1, wherein the first grounding member has a grounding tab extending therefrom for soldering to a grounding pad of an external printed circuit board.

8. The audio jack connector as claimed in claim 1 further comprising a metal collar for engaging with the top of each cylinder.

9. The audio jack connector as claimed in claim 3, wherein the second grounding member defines at least a hole for engaging with the corresponding tubes of the first grounding member.

10. The audio jack connector as claimed in claim 9, wherein at least one slit is defined in the second grounding member in communication with the corresponding hole for facilitating engagement of each hole with the corresponding tube.

11. An audio jack connector comprising:

an insulative housing having a mating face with at least a cylinder extending forward from the mating face;

retention means extending forward from the mating face;

a first grounding member comprising a metal base adapted to be attached to the mating face, and a metal tube extending from said metal base for receivably engaging the cylinder wherein the retention means of the housing engages the metal base of the first grounding member for preventing the first grounding member from axial withdrawal from the housing; and a second grounding member being provided and adapted to be attached to the first grounding member, and including engaging devices for directly fastening the second grounding member to the housing.

12. The audio jack connector as claimed in claim 11, wherein the retention means includes a pair of hooks for latchably engaging the metal base of the first grounding member.

13. The audio jack connector as claimed in claim 11, wherein the second grounding member is of a plate like structure including at least a hole for receivable compliance with the metal tube of the first grounding member.

14. An arrangement of grounding/shielding of an audio jack connector comprising:

a first grounding member including a metal base attached to a mating face of said audio jack connector, and at least one metal tube extending from said metal base and adapted to receive a corresponding cylinder forward extending from said mating face of said audio jack connect; and a second grounding member being directly fastened to a housing and being in a form of a plate attached to said first grounding member so that the metal base of the first grounding member is sandwiched between the mating face of the housing and the second grounding member.

15. The arrangement as claimed in claim 14, wherein the first grounding member is latched to the housing by hooks extending forward from the mating face of the housing.

16. The arrangement as claimed in claim 14, wherein the second grounding member includes at least one hole in compliance with the metal tube of the first grounding member.

* * * * *